US005297727A

United States Patent [19]

Brioux

[11] Patent Number: 5,297,727

[45] Date of Patent: Mar. 29, 1994

[54] CARTON

[76] Inventor: Murray J. Brioux, 11 Royal Doulton Drive, Don Mills, Ontario, Canada, M3A1N3

[21] Appl. No.: 890,448

[22] Filed: May 29, 1992

[51] Int. Cl.[5] ..... B65D 5/54

[52] U.S. Cl. ..... 229/227; 229/145; 229/225; 229/226; 229/905

[58] Field of Search ..... 229/225, 226, 227, 238, 229/239, 145, 905

[56] References Cited

U.S. PATENT DOCUMENTS

| | | | |
|---|---|---|---|
| 2,909,312 | 10/1959 | Conerty | 229/238 |
| 3,165,254 | 1/1965 | Moore | 229/227 |
| 3,168,974 | 2/1965 | Buttery et al. | 229/227 |
| 3,206,096 | 9/1965 | Struble | 229/227 |
| 3,206,101 | 9/1965 | Holmes | 229/227 |
| 3,219,257 | 11/1965 | Anderson | 229/227 |
| 5,007,541 | 4/1991 | Gunn et al. | 229/227 |
| 5,161,734 | 11/1992 | Ruehl et al. | 229/227 |

FOREIGN PATENT DOCUMENTS

| | | | |
|---|---|---|---|
| 714412 | 8/1965 | Canada | 229/227 |
| 278,751 | 8/1988 | European Pat. Off. | 229/238 |
| 344996 | 12/1989 | European Pat. Off. | 229/238 |

*Primary Examiner*—Gary E. Elkins

*Attorney, Agent, or Firm*—Michael J. McGreal; Robert C. Sullivan

[57] ABSTRACT

The present carton has a tear strip that is fully removed from the carton when the carton is opened. This is the case since the tear strip and associated adhesive is only across the front panel and the two pendant side flaps. It is not across the rear panel to which the lid remains hingedly attached after opening. In addition the side flaps attached to the front and rear panels are of a size of essentially that of the side of the carton which provides the carton with additional stacking strength.

14 Claims, 2 Drawing Sheets

CARTON

BACKGROUND OF THE INVENTION

This invention relates to a carton having a tear strip opening for a closure where the tear strip is removed completely from the carton when the carton is opened but yet the lid remains attached to the carton. In addition the carton blank is arranged so that the sides of the carton are of a double thickness to provide increased stacking strength.

The present carton is useful for packaging particulate products such as detergents, sugar, coffee, cements and plasters. These products are usually scooped out of a carton when the carton is opened. There is a need in such cartons for the carton to be easily opened in a manner where the tear strip is fully removed from the carton in a neat tear. If the tear strip is fully removed from the carton along with any adhesive and plastic components of the tear strip the carton then can be recycled as a fully paperboard product. In recycling the material being recycled should be of a single component. When a material is multi-component recycling is difficult. Either the components has to be separated by hand at the time of recycling or a use have to be found for the recycled combined materials. In the present instance the tear strip which contains hot melt adhesives and a plastic strip will be entirely removed when the carton is opened by the consumer. This is the case even though the lid remains hingedly attached to the carton. There is left solely a paperboard to be recycled.

This carton also has an increased strength due to the side flaps which serve to strengthen the carton. The side flaps extending from the front panel and from the rear panel are of an extended length for greater overlapping and serve to reinforce the carton. The side flaps encompass the full sidewalls of the carton. It is also a feature that the glue flap extends the length of the carton along the bottom of the carton. This serves to reinforce the bottom of the carton and to provide a sift proof seal for the bottom of the carton.

BRIEF SUMMARY OF THE INVENTION

This invention is directed to a carton where the tear strip, associated plastic and non-water soluble adhesives are removed from the carton along with the tear strip. This is the result of the tear strip not extending across the rear panel of the carton as is usually the case. In addition the carton is reinforced through the location, size and shape of the side flaps and the glue flap. In particular the side flaps are each essentially the full dimension of the side of the carton which results in a double wall along each side. This permits the cartons to be stacked higher in displays without the carton bowing.

The present carton is made from a carton blank where the major dimension of the carton blank is transverse to the direction of the roll of paperboard from which it is cut. The tear strip is applied to the paperboard longitudinally to the direction of the paperboard roll but the print and major dimension of the carton are transverse to the direction of the paperboard roll. Thus the tear strip which is put on the paperboard roll continuously in the longitudinal direction will only appear across the front panel and two associated flaps of the carton blank. In this way when the carton is opened the lid will remain hingedly attached to the rear panel of the carton. The tear strip is fully removed from the carton but yet the lid remains attached to the carton.

DETAILED DESCRIPTION OF THE INVENTION

There is provided a carton where the tear strip that is used to open the carton is fully removed from the carton but yet the lid is hingedly attached to the rear panel of the carton. There is no remnant of the tear strip or tear strip adhesive left on the carton. The reason is that the tear strip is not also across the rear panel.

In producing a carton that has a tear strip the tear strip and associated adhesives are continuously applied to a paperboard as it is unwound from a roll. This is applied longitudinally along the roll. Depending on the width of the roll a number of tear strips can be simultaneously applied to the paperboard roll. In the usual case carton blanks are cut from the paperboard roll where the major dimension of the carton blank is in the longitudinal direction of the paperboard roll. However, in the present instance while the tear strip is applied to the paperboard roll in the longitudinal direction the carton blanks are cut so that the major dimension of the carton blank is in the transverse dimension of the paperboard roll. In this way the tear strip and associated adhesives will traverse only the front panel and its two associated side flaps. Also the print on the paperboard roll will be aligned to be read in the transverse direction rather than in the longitudinal direction as is usually the case.

Figure 1:
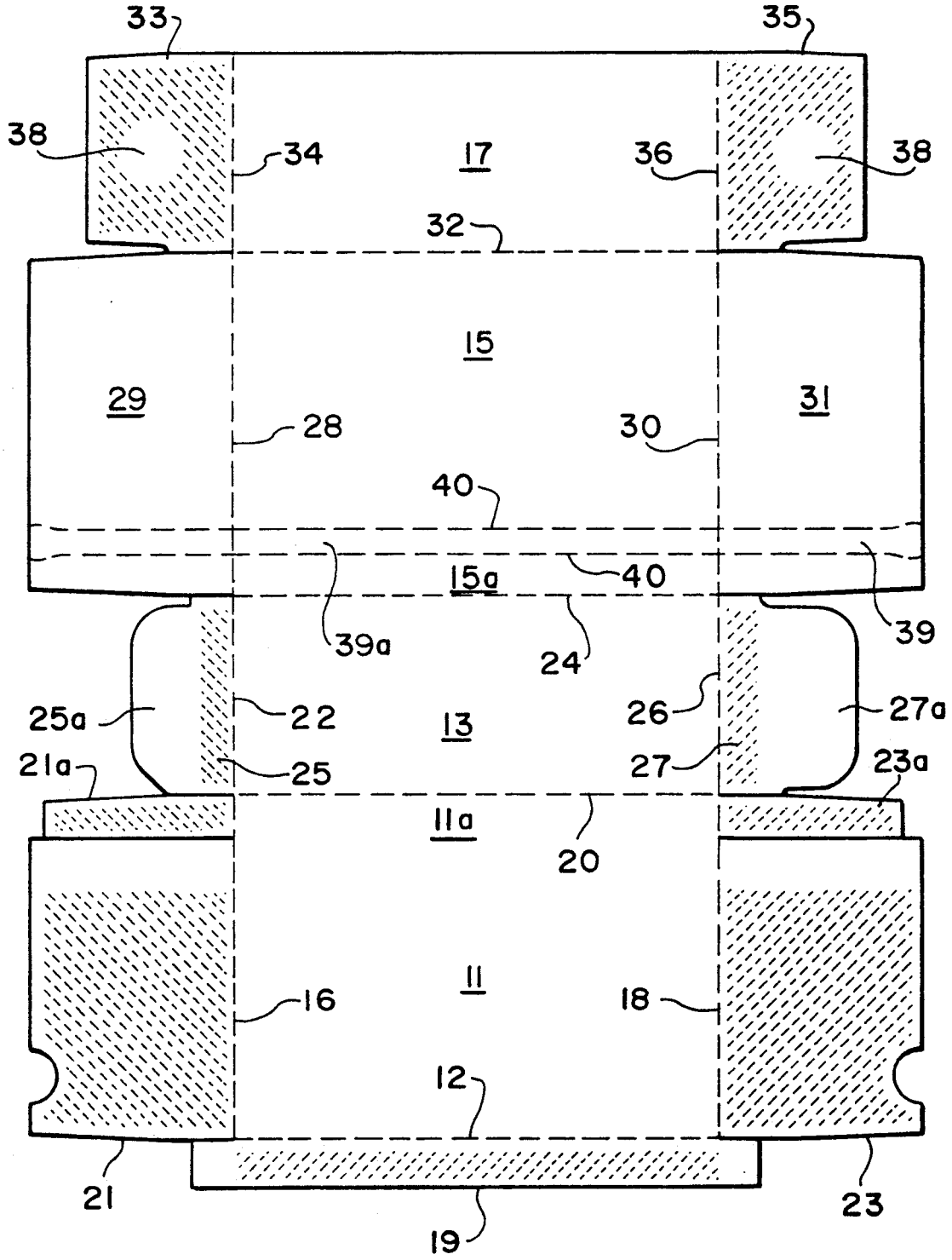
FIG. 1 is a plan view of the carton blank.

The box blank is described in FIG. 1. This box blank consists of major panels 11, 13, 15 and 17. Panel 11 is the rear panel, panel 13 the top panel, panel 15 the front panel and panel 17 the bottom panel. Flap 19 is the glue flap. Score line 16 delineates minor side flap 21 from the rear panel and score line 18 delineates minor side flap 23 from the rear panel. Flaps 21(*a*) and 23(*a*) are segments of flaps 21 and 23 respectively and are at least partially cut through the paperboard. These segments permit the tear strip to be removed from each side of the carton.

The top panel 13 has score lines 22 and 26 which delineate minor side flaps 25 and 27. Sections 25(*a*) and 27(*a*) are debossed areas of flaps 25 and 27 respectively. The debossing together with the over lacquer help to minimize glue adhesion to the inside of the outer side flap. This is necessary to enable the lid to release after the tear strip is removed. Score lines 20 and 24 are scored fold points for assembly of the carton.

The front panel 15 has major side flaps 29 and 31 which are delineated by score lines 28 and 30 respectively. The tear strip 39 extends across the front flap and each side flap. Section 15(*a*) will be the part of the front flap that will remain with the top lid when the tear strip is removed and the carton is opened. The score lines 40 are on either side of the tear strip are partially cut through the paperboard. These score lines provide a point where the tear strip can be severed from the carton. Tabs 39(*a*) on either end of the tear strip provide a point to grip the tear strip at the time that it is to be removed.

The remaining panel is bottom panel 17 which has minor side flaps 33 and 35 which are delineated by score lines 34 and 36 respectively. Each of the side flaps has a debossed area 38.

The shaded areas of the side flaps and glue flap designates an adhesive region. The adhesive region is preferably scored so as to better accept adhesive and to form stronger bonds. The non-shaded areas of the minor flaps, except for flaps 29 and 31, are varished so that an adhesive will not adhere to these areas. The surface of flaps 29 and 31 face the exterior and will carry print material.

Figure 2:
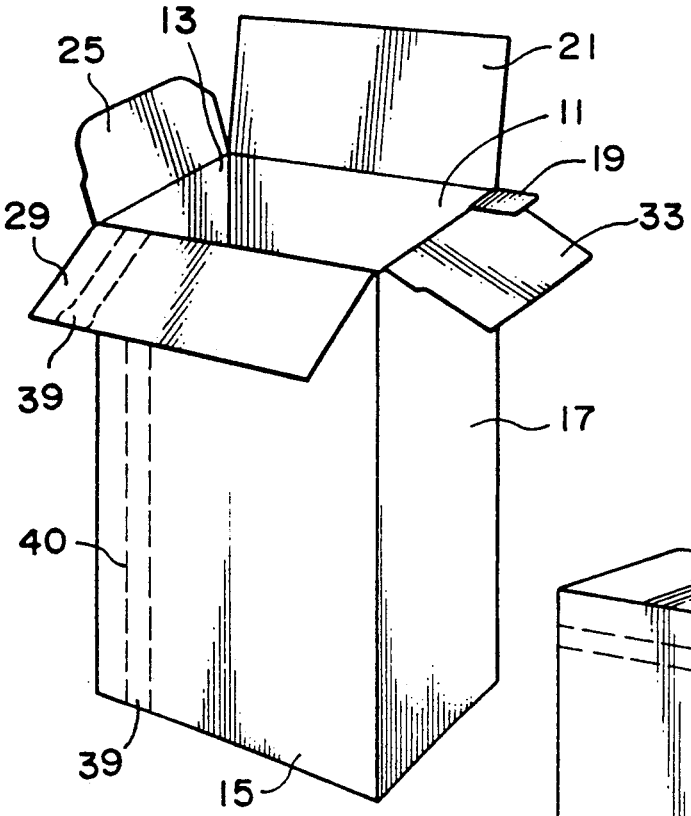
FIG. 2 is a perspective view of the carton with a side unassembled and in a condition for filling.
Figure 3:
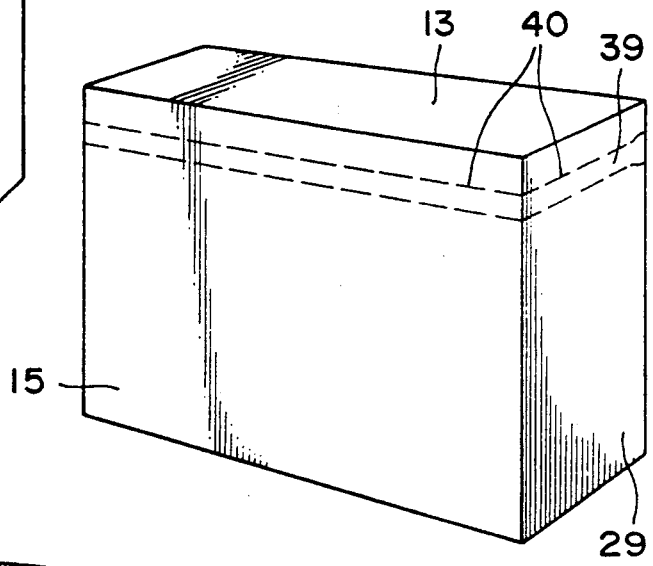
FIG. 3 is a perspective view of the carton assembled and closed.

FIG. 2 is a carton that has been partially assembled from the carton blank of FIG. 1. One set of side flaps have been left unsealed so that the carton can be filled. After the carton is filled it is sealed to form the carton of FIG. 3. This sealed carton has essentially doubled side flaps. This gives the carton additional strength when stacked on a shelf. There is a decreased tendency of the carton to bow under the weight of cartons that it is supporting.

Figure 4:
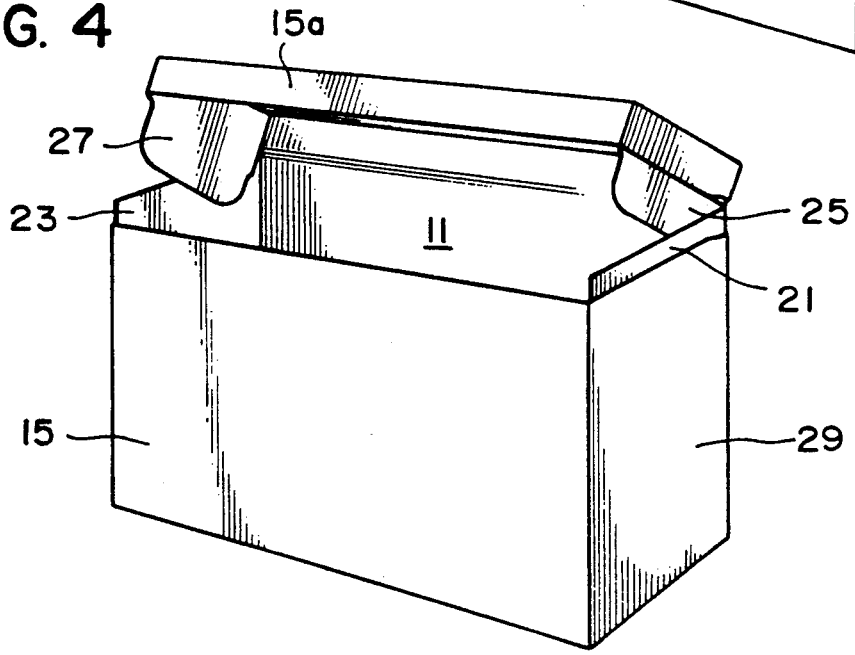
FIG. 4 is a perspective view of the carton with the tear strip removed and the lid partially opened.

In FIG. 4 there is shown the carton in an opened position. The tear strip 39 has been entirely removed from the carton. Likewise any adhesive associated with the tear strip has been removed from the carton. This is the case since the tear strip was never applied to the rear panel. The result is that this carton when it has been emptied of product it can be readily recycled. There will not be a residue of unsoluble organic adhesive in the pulp when it is to be reused.

The cartons can be produced from any grade of paperboard, including corrugate. The type of paperboard that is used will be dictated by the carton that is to be produced. The tear strip can be one that is comprised of the paperboard itself reinforced with an adhesive, a plastic tape applied to the paperboard with an adhesive, or a string that is attached to the paperboard with an adhesive. The usual adhesive that is used is a hot melt adhesive. These adhesives are fast setting and are useful in continuous manufacturing operations This carton and carton blank can be modified in various ways. However all such techniques for providing for a tear strip that is fully removed from the carton, but where the lid remains hinged to the carton are within the present carton development.

What is claimed is:

1. A carton comprising a front panel hingedly connected to a bottom panel and to a top panel, a rear panel hinged to said top panel, and side flaps hingedly attached to each of said front panel and said rear panel for defining side panels of said carton, a tear strip attached to said front panel and to the side flaps attached to said front panel but free of any attachment to the rear panel and the side flaps attached to the rear panel, and said bottom panel being adhesively attached to said rear panel.

2. A carton as in claim 1 wherein a glue flap is hingedly attached to said rear panel.

3. A carton as in claim 1 wherein the side flaps of said rear panel have segments cut therefrom adjacent the tear strip in the side flaps hingedly attached to said front panel, said segments being hingedly attached to said rear panel.

4. A carton as in claim 1 wherein side flaps hingedly attached to said front panel and the side flaps hingedly attached to said rear panel are essentially of the same dimensions.

5. A carton as in claim 4 wherein each of the side flaps have a dimension essentially the same as said side panels of the carton to provide greater stacking strength to the carton.

6. A carton blank comprising a planar section of paperboard that has been scored to separate said paperboard into a front panel, a real panel, a top panel and a bottom panel, each of said panels having pendant flaps, a tear strip transversing the front panel and the flaps pendant thereto, the remaining of said panels and pendant flaps being free of said tear strip and any associated adhesive, said front panel being hingedly connected to said bottom panel and to said top panel, and said rear panel being hingedly attached to said top panel.

7. A carton blank as in claim 6 wherein the pendant flaps of said front panel and the pendant flaps of said rear panel are essentially of the same size.

8. A carton blank as in claim 7 wherein the pendant flaps of said front panel and the pendant flaps of said rear panel will essentially overlap when formed into a carton.

9. A carton blank as in claim 6 wherein said pendant flaps of said rear panel have a portion at least partially severed at an upper portion thereof.

10. A carton comprising a front panel and a rear panel, said front panel and said rear panel having opposite transverse side edges, side flaps pendent from each side edge thereof, each side flap being dimensioned to define a side panel of said carton, a top panel hingedly attached at one longitudinal edge to said front panel and at a second longitudinal edge to said rear panel, a bottom panel hingedly attached to the other longitudinal edge of said front panel, and a tear strip attached to said front panel and to said side flaps attached to said front panel without extending to said rear panel or said side flaps depending from said rear panel.

11. The carton of claim 10 wherein said carton further includes a bottom panel having a front edge hingedly attached to a bottom edge of said front panel and a rear edge adhesively attached to a bottom edge of said rear panel.

12. The carton of claim 11 wherein said carton includes a glue flap depending form said bottom edge of said rear panel, said glue flap being adhesively attached to said rear edge of said bottom panel.

13. A carton blank comprising a planar section of paper board having scoring to define a front panel, a rear panel, a top panel and a bottom panel, each of said panels having pendant side flaps, said side flaps pendant from said front panel and said rear panel being dimensioned to define a side panel of said carton and to overlap when formed into a carton; a top panel hingedly attached at one longitudinal edge to said front panel and at a second longitudinal edge to said rear panel; a bottom panel hingedly attached to the other longitudinal edge of said front panel; and a tear strip traversing said front panel and said side flaps pendant thereto, said rear, top and bottom panels and dependent side flaps being free of said tear strip.

14. The carton blank of claim 13 wherein said rear panel has a bottom edge hingedly attached to a glue flap.

* * * * *